United States Patent [19]

East

[11] 4,184,299

[45] Jan. 22, 1980

[54] ROOF CONSTRUCTION

[75] Inventor: James R. East, Spring, Tex.

[73] Assignee: A & S Building Systems, Inc., Houston, Tex.

[21] Appl. No.: 897,904

[22] Filed: Apr. 19, 1978

Related U.S. Application Data

[63] Continuation-in-part of Ser. No. 810,113, Jun. 27, 1977, abandoned.

[51] Int. Cl.[2] ..... E04D 1/36

[52] U.S. Cl. ..... 52/463; 52/466

[58] Field of Search ..... 52/466, 463, 461, 459, 52/460, 469, 467, 465, 520, 542, 550, 462, 468, 712, 714, 715

[56] References Cited

U.S. PATENT DOCUMENTS

| | | | |
|---|---|---|---|
| 1,693,274 | 11/1928 | Hayman | 52/466 |
| 2,296,046 | 9/1942 | Miller | 85/11 |
| 2,305,122 | 12/1942 | Wiley | 52/466 |
| 2,392,179 | 1/1946 | Paley | 85/11 |
| 2,735,383 | 2/1956 | Gerbracht | 52/466 |

*Primary Examiner*—John E. Murtagh

[57] ABSTRACT

A roof construction having supporting purlins or the like. It includes a plurality of support clips secured to the purlins, with each support clip having a flat upper portion having a slot therein. A plurality of roof panels having an upstanding seam portion along each long side thereof, with each seam portion overlaying at least two of the support clips and each of the seam portions having downwardly facing shoulders. The construction includes a plurality of generally spear shaped fastener clips inserted between the adjacent seam portions of two adjacent panels, with each of the clips extending downwardly through one of the slots engaging one of the support clips. The upper ends of each of the fastener clips have means for engaging the two adjacent seam portions to thereby secure the panel to the support clips. An elongated cap is provided for covering the adjacent seam portions and engaging the shoulders presented by the seam portions, to seal the seams.

8 Claims, 4 Drawing Figures

2
40
13
12
11
16
32
33
15
15
17
14
29
13
26
28
21
20
2

FIG. 2
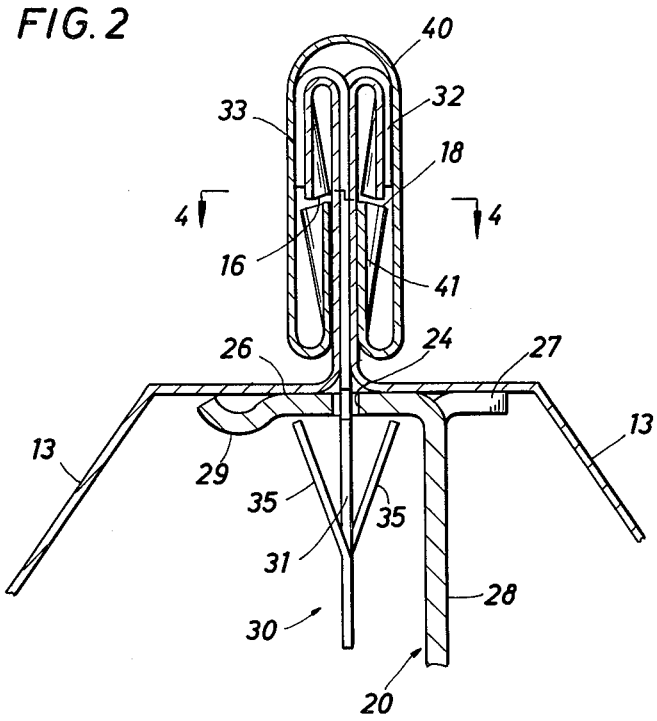
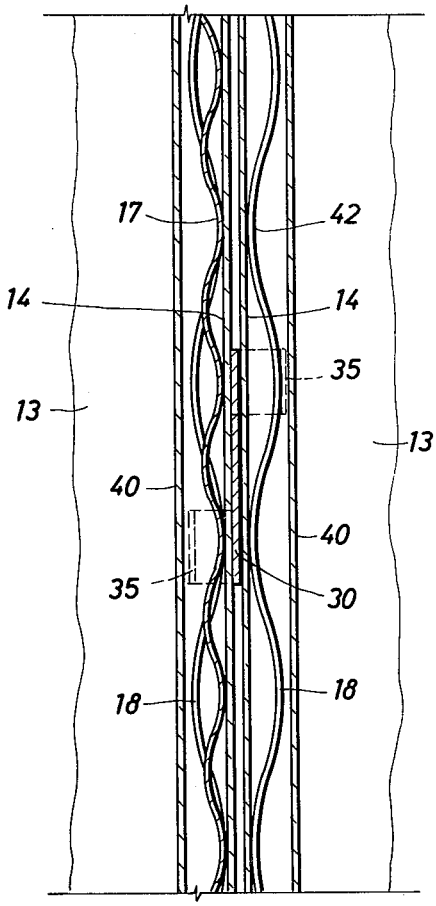
FIG. 4
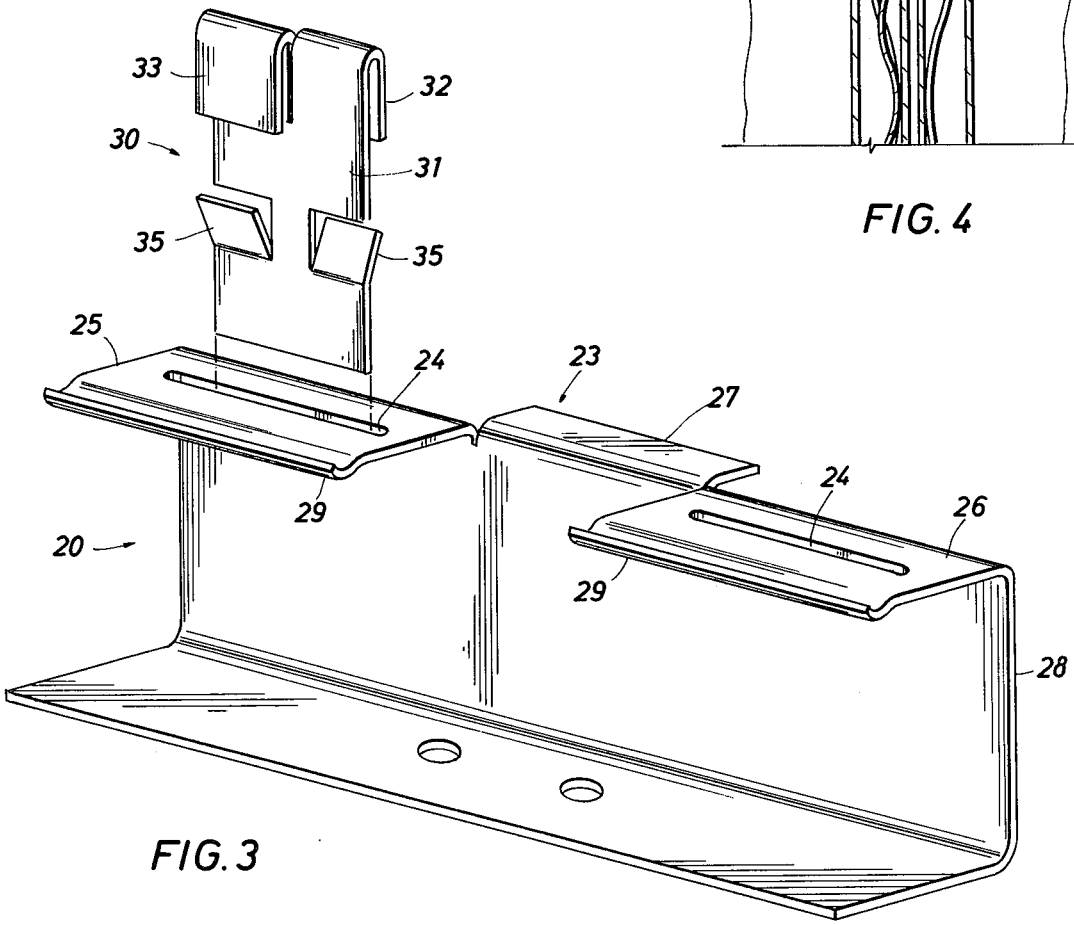
FIG. 3

ROOF CONSTRUCTION

CROSS-REFERENCE TO RELATED APPLICATION

This is a continuation-in-part of my copending application Ser. No. 810,113, filed June 27, 1977, now abandoned.

BACKGROUND OF THE INVENTION a. Field of the Invention

This invention generally relates to metal buildings and more particularly to a standing seam roof structure utilizing metal panels which are to be attached to a metal frame building or the like.

b. Description of the Prior Art

Various systems have been proposed for attaching metal panels to the roof structure of a metal building to provide the roof surface. All of the systems that have heretofore been developed have various shortcomings as compared with the present invention. One of the problems in attaching metal panels to the purlins of a roof structure, for example, includes the problem of securing the panels to the purlins and at the same time maintaining a waterproof structure. At the same time, it is desirable to have panels which are shaped in such fashion that they can be readily nested for shipping purposes. It is also desirable to have the components arranged such that they may be easily and quickly assembled on the building with a minimum of manual labor and without the necessity of utilizing special machines, such as crimping machines, for example.

SUMMARY OF THE INVENTION

It is, therefore, an object of this invention to provide a standing seam roof construction which overcomes the aforesaid disadvantage of the prior art and provides a roof system which has the aforesaid desirable characteristics.

Briefly stated, this invention is for a roof construction having supporting horizontally extending purlins or the like. It includes a plurality of generally elongated panels, each of which has a matching standing seam portion along the marginal edges of the long sides thereof, with each standing seam portion having an edge portion of the panel folded back thereover toward the center of the panel forming a downwardly facing shoulder. A plurality of support clips are provided and supported beneath the adjacent seam portions of two adjacent panels for securing the panels to the purlins. Each of the support clips has a flat upper surface below and perpendicular to the plane of the standing seam portions. The flat upper surface of the support clip has therein a slot through which is inserted a spear shaped fastener clip for securing the panels to support clip. Each of the fastener clips include a body portion arranged for inserting downwardly between adjacent seam portions and through one of the slots. The fastener clips each include means connected to the body portion for engaging the standing seam portions and means for engaging a support clip after passage of the body portion downwardly through one of the slots. Finally an elongated seam cap generally in the cross-sectional shape of an inverted U is mounted over the two adjacent standing seam portions and over the associated clips. The cap is provided with means for forming upwardly facing shoulders for engaging the downwardly facing shoulders of the standing seam portions for securing the cap thereover.

BRIEF DESCRIPTION OF THE DRAWINGS

FIG. 2 is a partial cross-sectional view taken across two adjacent seam portions and showing portions of a fastener clip and a support clip.

FIG. 3 is a partial perspective view of one of the fastener clips prior to the same being inserted into the support clip.

FIG. 4 is a sectional view taken generally along line 4—4 of FIG. 2 showing the arrangement of the shoulder means for retaining the cap over the seam.

DESCRIPTION OF THE PREFERRED EMBODIMENT

Figure 1:
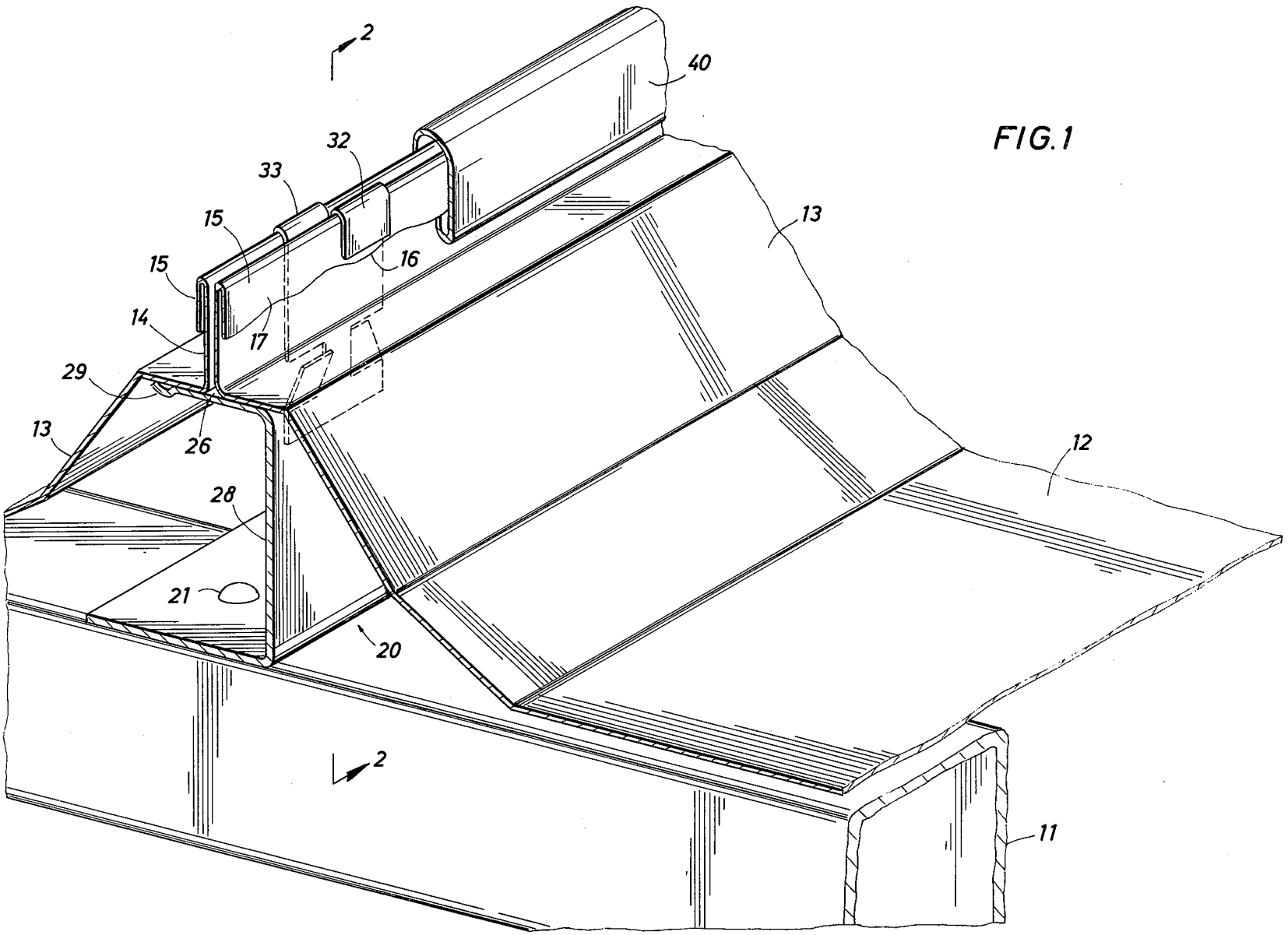
FIG. 1 is a partial perspective view showing certain features of the present invention.

The invention relates to a roof construction which is arranged to have horizontally extending purlins such as purlin 11 spaced at desired intervals for supporting a plurality of panels 12. Panels 12 are generally elongated metal panels having a raised panel leg 13 on each edge thereof, which legs are generally mirror images of each other. As a result, panels 12 will readily nest one upon the other for transportation purposes to the construction site. Each panel leg 13 terminates in an upstanding seam portion 14 having an edge portion folded back thereover forming seam wing 15 having a plurality of curved recess 17therein. It will be observed that the downwardly extending end surface of wing 15 along with recesses 17 provide a downwardly facing shoulder 16, which in the preferred embodiment comprises a sinuous curve, best seen in FIG. 4, and the purpose of which will be explained hereinafter.

The standing seam portions 14 of two adjacent panels 12 are arranged for support by a plurality of panel support clips, designated generally by the numeral 20, each of which is arranged for attachment to a purlin 11, as by bolts 21. Support clips 20 are shaped generally as shown in FIG. 3 and provide a flat upper surface designated generally by the numeral 23, which comprises three portions 25, 26 and 27 supported by a leg 28. Portions 25 and 26 are each provided with an elongated slot 24 and a rib 29, the function of which will be explained hereinafter. Each support clip 20 underlies, supports and is otherwise adjacent two standing seam portions 14 of two adjacent panels 12. Sufficient support clips 20 are provided to give adequate support to panels 12 and hence are spaced along the purlin and beneath the standing seam portions 14 of two adjacent panels 13. As an alternative structure, support clips 20 may take the form of a continuous beam having a plurality of slots therein, but for purposes of this application, such a beam may be considered as a plurality of support clips.

Panels 12 are arranged for attachment to support clips 20 by means of a plurality of fastener clips 30 which may be described as being generally spear shaped in configuration when viewed in cross section, as for example in FIG. 2. Fastener clips 30 are formed of a clip body 31 which is generally plainer in configuration and sized for passage through slot 24. The upper end of body 31 has attached thereto two downwardly extending clip wings, one of which is designated by the numeral 32 on one side and the other of which is identified by the numeral 33. Wings 32 and 33 are sized and shaped for fitting over the upper edges of seam portions 14, as best shown in FIGS. 1 and 2.

The lower end of clip body 31 has attached thereto a pair of resilient and generally upstanding clip legs 35, each of which is arranged for extending transversely outwardly from clip body 31. Clip legs 35 are resilient such that as clip body 31 is forced downwardly through slot 24, clip legs 35 are urged inwardly and when he upper ends of clip legs 35 clear slot 24, spring outwardly as shown in FIG. 2 to thereby engage the lower side of upper portion 23 of a support clip 20.

After panels 12 have been secured to support clips 20 by fastener clips 30, pressure differentials above and below panels 12 sometimes occur, as for example during windstorms, which tend to lift panels 12 upwardly. Such upward lift forces can be quite large and tend to spread legs 35 further apart than is intended. If the lift forces are excessively large, legs 35 may become inverted and sheared off by slot 24. To prevent any such shearing, the spread of legs 35 is limited by rib 29 and the inner portion of leg 28, which are positioned such that legs 35 are not spread past their elastic limits.

As best seen in FIG. 2, the ends of legs 35 are shortened to be vertically spaced apart from body portion 31 of clip 30 so that clip 30 can travel within and parallel to slot 24. The travel of clip 30 allows and compensates for expansion of panels 12 in the direction parallel to slots 24. Expansion in the direction perpendicular to slots 24 is allowed and compensated for by flexion of leg 13.

In order to weather seal the seam between seam portions 14 of adjacent panels 12, there is provided a generally elongated seam cap 40 which is generally of an inverted U-shaped configuration in cross-section. Seam cap 40 is dimensione for mounting over the adjacent pair of seam portions 14 of two adjacent panels 12, as well as over the associated fastener clips 30, thereby preventing entry of rain and the like through the seam. Seam cap 40 is arranged for holding in place by generally upstanding shoulder means in the form of a cap flange 42 on each edge thereof which is turned inwardly and upwardly as best shown in FIG. 2. Cap flanges 41 are each provided with a plurality of curved recesses 42, which in the preferred embodiment form a sinuous curve of a different period from that of seam wing 15 and which thereby present upstanding shoulders 18 for engaging the downwardly extending shoulder 16 of each of the seam wings 15. The spring tension in the upper radius of seam cap 40 causes shoulders 16 and 18 to lock together. However, if a panel 12 becomes damaged, seam cap 40 may be removed without damage thereto, so that the damaged panel 12 may be replaced.

In operation, it will be assumed that the building to which the roof structure is to be applied will include a plurality of horizontally extending purlins 11 having the desired spacing to support the desired load and arranged one with respect to the other to give the desired pitch to the roof. Support clips 20 are attached to the purlins 11 at the desired locations so as to be positioned immediately beneath the marginal edge of two panels 12 as shown in FIGS. 1, 2 and 4.

Thereafter, a plurality of panels 12 are applied over purlins 11, with the marginal edges thereof abutting as shown in FIG. 1 and with a seam portion 14 of a panel 12 being proximate the seam portion 14 of adjacent panel 12. With two adjacent panels 12 thus positioned, fastener clips 30 are inserted between and through the space between seam portions 14 and downwardly through a slot 24. As downward pressure is applied on each fastener clip 30, the respective clip legs 35 are deflected inwardly until slot 24 is cleared, at which point clip legs 35 are arranged to spring outwardly to engagement with support clip 20 as shown in FIG. 2. Thus positioned, it will be observed that clip wings 32 and 33 have engaged the upper edges of seam portions 14 and seam wings 15, thereby securing panels 12 in place. Two fastener clips 30 are applied to and connected with each support clip 20 in a similar fashion.

A cap seam 40 is thereafter placed over the standing seam formed by seam portions 14 and over the upper ends of the respective fastener clips 30 as shown in FIGS. 1 and 2. In so positioning, it will be noted that the upper edge of flanges 41 in the area of the recesses 42 engage with the shoulder 16 formed by the lower edges of seam wings 15, to thereby secure seam cap 40 in place. It is to be understood that seam cap 40 is of a resilient material so that it may be spread sufficiently wide to pass over seam wing 15 and thereafter spring into position in engagement as shown in FIG. 2. It is to be further understood that seam cap 40 may be initially provided with a sufficient amount of sealant material so as to create a water tight seal with respect to seam portions 14.

It will be evident that this invention provides a roofing system which does not require any special crimping machines or apparatus. It can be assembled with a minimum of operational steps by the installation crew and nevertheless provides a secure and quickly assembled roof structure.

Further modifications and alternative embodiments of the apparatus and method of this invention will be apparent to those skilled in the art of view of this description. Accordingly, this description is to be construed as illustrative only and is for the purpose of teaching those skilled in the art the manner of carrying out the invention. It is to be understood that the form of the invention herewith shown and described is to be taken as the presently preferred embodiment. Various changes may be made in the shape, size and arrangement of parts. For example, equivalent elements or materials may be substituted for those illustrated and described herein, parts may be reversed, and certain features of the invention may be utilized independently of the use of other features, all as would be apparent to one skilled in the art after having the benefit of this description of the invention.

What is claimed is:

1. In a roof construction having supporting purlins or the like, the combination comprising:

a plurality of generally elongated panels each of which has a matching standing seam portion along the marginal edges of the long sides thereof, each standing seam portions having an edge portion of said panel folded back thereover toward the center of said panel, wherein said edge portion has therein a plurality of recesses, forming downwardly facing shoulders;

a plurality of support clips supported beneath the adjacent seam portions of two adjacent panels for securing said panels to said purlins, said support clips each having a flat upper surface spaced below and perpendicular to the plane of said standing seam portions and with said upper surface having a slot therein;

a plurality of generally spear shaped fastener clips securing said panels to said support clips, each of said fastener clips including a body portion arranged for inserting downwardly between said adjacent standing seam portions and through one of said slots, said fastener clips each including means connected to said body portion for engaging said standing seam portions and means for engaging said support clips after passage of said body portion downwardly through one of said slots;

an elongated seam cap generally in the cross-sectional shape of an inverted U, mounted over said two adjacent standing seam portions and over said associated clips, said cap having means for forming upwardly facing shoulders for engaging said downwardly facing shoulders of said standing seam portions, for securing said cap thereover;

wherein said upwardly facing shoulders of said seam cap form a first sinuous curve, and said downwardly facing shoulders of said standing seam portion form a second sinuous curve, wherein said first and second sinuous curves are of different periods.

2. The invention as claimed in claim 1 wherein:

the slots in said upper surfaces of said support clips are generally elongated and parallel with the longitudinal space between said adjacent seam portions.

3. The invention as claimed in claim 1 wherein:

each of said fastener clips has wing shaped portions attached to the upper end thereof for mounting over and thereby engaging said seam portions.

4. The invention as claimed in claim 1 wherein:

each of said fastener clips has at least one resilient clip leg attached thereto, said leg having an upstanding free end which extends outwardly from said body portion a distance which is greater than the width of said slot, whereby said leg is deflected to a generally flat configuration with said body portion during passage downwardly through said slot, and thereafter springs outwardly therefrom to engage the lower side of said flat upper surface of said support

5. The invention as claimed in claim 4 wherein:

each of said fastener clips has two of said clip legs, each of which extends outwardly from opposite sides of said fastener clip body.

6. The invention as claimed in claim 5 wherein:

the length of said legs is such that when said fastener slips are engaged with said support clips said fastener clips are able to slide within said slot in a direction parallel thereto, such that expansion in said panels in the direction parallel to said slot is allowed.

7. The invention as claimed in claim 5 including:

means for limiting the outward extension of said legs from said fastener clip body when said legs are in engagement with said lower side of said support clip.

8. The invention as claimed in claim 1 wherein:

said shoulder forming means on said seam cap includes an inwardly turned upstanding edge portion attached to each side of said cap.

* * * * *

UNITED STATES PATENT AND TRADEMARK OFFICE

CERTIFICATE OF CORRECTION

PATENT NO. : 4,184,299

DATED : January 22, 1980

INVENTOR(S) : James R. East

It is certified that error appears in the above-identified patent and that said Letters Patent are hereby corrected as shown below:

Column 3, line 6, delete "he" and insert —the—; line 32, delete "dimensione" and insert —dimensioned—; line 38, delete "42" and insert —41—. Column 4, line 52, delete "portions" and insert --portion—; column 6, line 7, after the word "support" insert —clip.—; line 14, delete "slips" and insert —clips—.

Signed and Sealed this

*Twenty-ninth* Day of *April 1980*

[SEAL]

*Attest:*

SIDNEY A. DIAMOND

*Attesting Officer*

*Commissioner of Patents and Trademarks*